United States Patent [19]

Heyl

[11] Patent Number: 4,843,950

[45] Date of Patent: Jul. 4, 1989

[54] ADJUSTABLE AXIAL PISTON MACHINES

[75] Inventor: Walter Heyl, Johannesberg, Fed. Rep. of Germany

[73] Assignee: Linde Aktiengesellschaft, Wiesbaden, Fed. Rep. of Germany

[21] Appl. No.: 680,843

[22] Filed: Dec. 12, 1984

Related U.S. Application Data

[62] Division of Ser. No. 414,668, Sep. 3, 1982, Pat. No. 4,515,067.

[30] Foreign Application Priority Data

Sep. 9, 1981 [DE] Fed. Rep. of Germany ..... 3135605

[51] Int. Cl.[4] ..... F01B 13/02; F04B 1/26

[52] U.S. Cl. ..... 91/506; 92/12.2

[58] Field of Search ..... 91/472, 486–488, 91/499, 504–507; 417/222; 92/12.2

[56] References Cited

U.S. PATENT DOCUMENTS 3,274,948 9/1966 Baits ..... 91/506

3,682,044 8/1972 Ankeny et al. ..... 91/506 X 4,142,452 3/1979 Forster et al. ..... 91/506

FOREIGN PATENT DOCUMENTS 2254809 6/1973 Fed. Rep. of Germany ..... 91/488

134795 3/1979 German Democratic Rep. ... 91/488

1508265 4/1978 United Kingdom ..... 91/499

*Primary Examiner*—William L. Freeh

*Attorney, Agent, or Firm*—Thomas R. Shaffer

[57] ABSTRACT

An adjustable axial piston machine of swash plate construction is provided in which the working pistons are supported against a swash plate that is formed on a rocker body 6, which in turn is supported with a semi-cylindrical support surface against a hollow-cylindrical bearing surface 4, in which case at least one pressure pocket recess 7, 57 is provided for generating a pressure cushion counteracting the bearing loads and it is connected with the high pressure line through channels in the servo piston that is capable of sliding in the operating cylinder loaded with high pressure.

3 Claims, 1 Drawing Sheet

ADJUSTABLE AXIAL PISTON MACHINES

This application is a divisional of my copending Ser. No. 414,668, filed Sept. 3, 1982, now pat. No. 4,515,067.

This invention relates to adjustable axial piston machines and particularly to adjustable swash plate axial machines with a rocker body having friction bearings.

The invention concerns an adjustable axial piston machine that operates selectively as a motor or preferably as a pump, with a housing and with an adjusting mechanism consisting of at least one operating cylinder connected with the high pressure line and with a servo piston capable of sliding in it, and with a revolving cylindrical drum with cylindrical boreholes in which working pistons are capable of sliding and which are supported against a swash plate that is formed on a rocker body that is in operating connection with the adjusting mechanism and which has a semi-cylindrical support surface that is supported against a hollow-cylindrical bearing surface located in the housing, in which case a pressure pocket recess in which a pressure cushion can be formed by pressure buildup is located in one of its surfaces and which can be located with pressure medium from the high pressure line through channels effected in the rocker body.

The arrangement of the pressure pocket recess in the bearing box that is solid with the housing and its loading with pressure medium from the high pressure line located on the other end of the housing through channels in the housing or external pipelines are known. This arrangement is very expensive and requires a housing proof against the high pressure in the case of channels located in the housing, and in the case of external pipelines it requires a good deal of assembly work, expensive pipe connections that easily become leaky and the pipe connections require additional space, inhibit accessibility in the immediate vicinity of the axial piston machine, and form inaccessible niches in which dirt can accumulate. On the other hand, the feeding of pressure medium through the working pistons and their slippers is structurally simple, but has the disadvantage that there is interference in the pressure cushion buildup under the slipper so that the pressure buildup in the pressure cushion is modified when it slides over the mouth of the channel in the rocker body. On the other hand, if the mouth of the channel in the rocker body is not covered by the slipper, the pressure cushion in the pressure pocket recess is relieved so that the pressure cushion cannot fulfill its purpose in this state. In addition, pressure medium periodically flows in this manner into the pressure pocket and out of it, such that a flow loss results. Furthermore, there is the danger that dirt present in the pressure pocket recess, e.g., bearing wear, assembly dirt, and the like, can pass through the channel in the rocker body under the slipper and cause increased wear there. A resuction from the pressure pocket recess and thus cavitation can also occur (DE-OS Nos. 22 54 809, 21 47 045, and U.S. Pat. No. 3,830,593).

The invention proposes a structurally simple solution for feeding the pressure medium to the pressure pocket recess, in which it is assured that the latter is always loaded with high-pressure fluid and the construction cost for the pressure medium feed is low.

In order to solve this problem, it is provided in accordance with this invention that the connection between the high pressure line and the channels in the rocker body, which are connected with the pressure pocket recess is provided by the operating cylinder and the servo piston so that the pressure medium standing in the operating cylinder can pass to the pressure pocket recess through the servo piston or through the boreholes and channels provided in the latter for the purpose of establishing the connection and through the channels in the rocker body. The fact that small amounts of pressure medium flow out in this manner from the operating cylinder during operation is not harmful since it is immediately followed up by the controlling or regulating mechanism and such a throughflow is even desirable under certain circumstances. The invention is advantageously applied in a swash plate pump in which the servo piston is capable of sliding in a differential cylinder or, instead of a differential cylinder with servo piston, two cylinders each with a servo piston engage on different sides of the swivel axis of the rocker body, in which case the two cylinders and accordingly the two servo pistons have different diameters so that forces are generated by the two pistons that continually press the rocker body into the bearing surface, whereby the position is determined by feeding in or draining out pressure medium from the operating cylinder of larger diameter.

If the axial piston machine is a swash plate pump that delivery in only one direction, in which thus the same channel is always the feed channel and which is provided for one direction of rotation, the pistons present on a certain side of the cylindrical drum are always the ones loaded with high pressure and consequently one side of the rocker body, against which these pistons loaded with high pressure are supported, is pressed with a great force into the bearing surface, while the other side is loaded only with a low force. In such a case it can be advantageous to provide the pressure pocket recess only on the side on which the pistons loaded with high pressure are supported against the swash plate.

In the foregoing general description of this invention certain objects,purposes and advantages of this invention have been set out. Other objects, purposes and advantages of this invention will be apparent from a consideration of the following description and the accompanying drawings in which.

Figure 1:
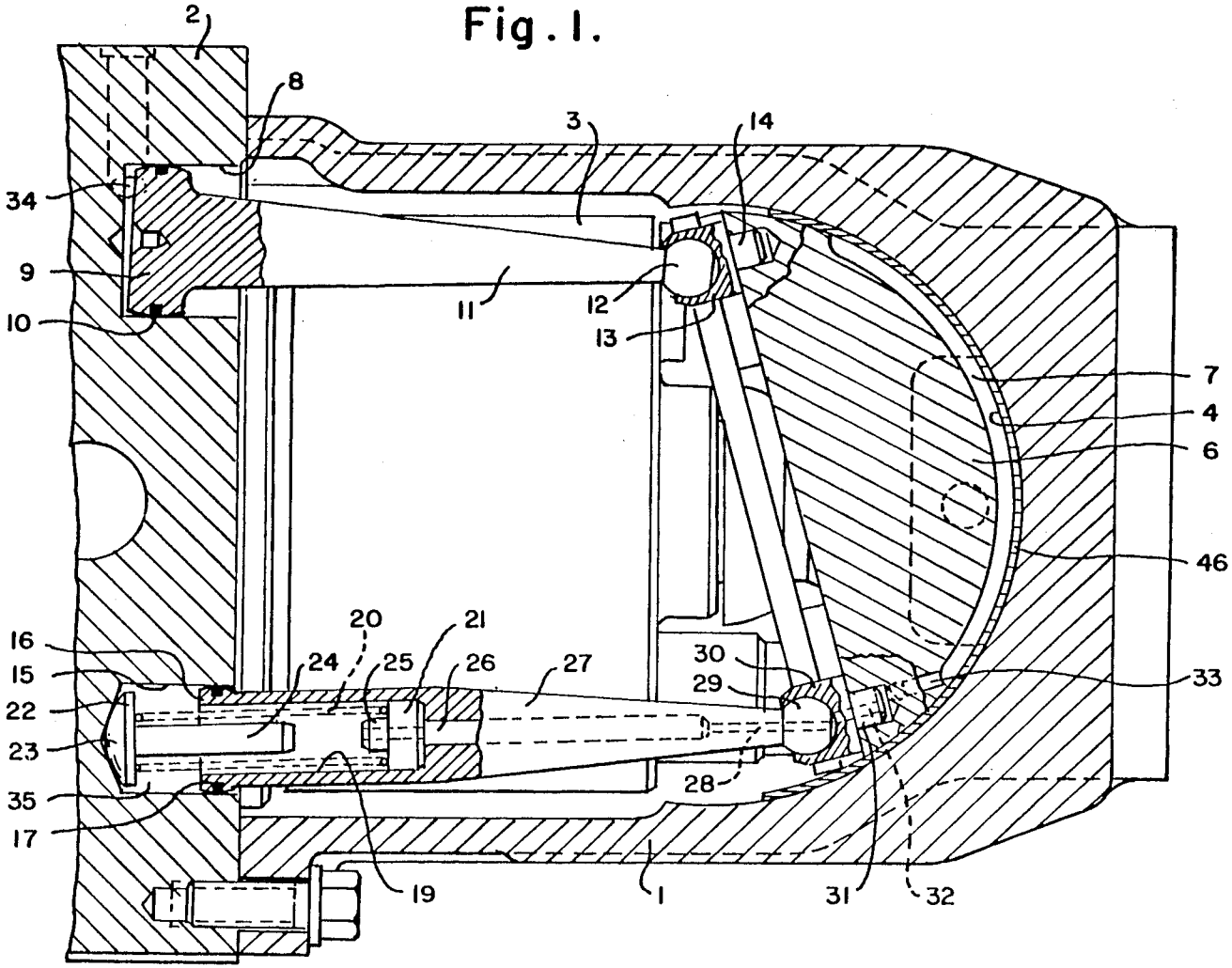
FIG. 1 shows a cross sectional view from the direction of the swivel axis of the rocker body of a swash plate pump.

Referring to the drawings, housing 1 is closed off by the housing bottom 2, in which the channels for delivering to and draining the fluid from the cylindrical drum 3 are simultaneously located. A hollow-cylindrical bearing surface 4 is formed in the housing 1 and the rocker body 6 is supported in it with a cylindrical surface 5, in which case a pressure pocket recess 7 is formed in the rocker body 6 in the cylindrical surface 5. On the upper side of the housing bottom 2, in the drawing, an operating cylinder 8 is provided in it, and a spherical servo piston 9 that is provided with a piston ring 10 for sealing is capable of sliding in it. The servo piston 9 is in one piece with the piston rod 11, on which a ball head 12 is formed and supported in a ball socket 13, which is inserted with a pin 14 into a corresponding borehole of the rocker body 6.

Analogously, an operating cylinder 15 is formed in the lower portion of the housing bottom 2 in FIG. 1. A servo piston 16 is capable of sliding in it. The servo piston 16 is also spherical just as the servo piston 9 and is provided with a sealing ring 17. However, operating cylinder 15 has a smaller diameter than operating cylinder 8. The two operating cylinders 8 and 15 are connected with the high pressure feed channel 18 through boreholes (not shown in the drawing) and a control mechanism.

A borehole 19 is effected in servo piston 16 and it contains a helper spring 20 that is supported against a spring plate 21 and also against a spring plate 22, which is supported with a ball cap 23 at the bottom of the operating cylinder 15 and has a prolongation 24 for the purpose of guiding the spring 20.

A borehole 25 is provided in the spring plate 21 and it is connected with a borehole 26 in the piston rod section 27, in which case the latter (27) is also in one piece with the servo piston 16, just as the piston rod 11 with the servo piston 9. In the more slender portion of the piston rod section 27 the borehole 26 extends into a borehole 28, which empties in the surface of the ball head 29 that is supported in a ball socket 30, which has an extension 31 that is supported in a corresponding borehole in the rocker body 6. A borehole 32 is also formed in the ball socket 30 and the pin 31 and it is connected in any position of the piston rod section 27 with the borehole 28 and is also connected with a borehole 33 in the rocker body 6, which empties in the pressure pocket recess 7.

As long as the axial piston machine is in the operation, the pressure chambers 34 in operating cylinder 8 and 35 in operating cylinder 15 are loaded with high pressure, in which case the volume enclosed in pressure chamber 34 is controlled by a control or regulating mechanism (not shown in the drawing). Compression forces are thus exerted on the servo pistons 9 and 16 and press the rocker body 6 against the bearing surface 4, in which case the swivel position assumed by the rocker body 6 is determined by the volume enclosed in pressure chamber 34. Pressure medium flows out of the pressure chamber 35 through the boreholes 19, 26, 28, 32, 33 into the pressure pocket 7 and forms a pressure cushion there, which exerts a force on the rocker body 6, which counteracts the force exerted by the operating piston capable of sliding in the cylindrical drum 3 and the forces exerted by the servo pistons 9 and 16.

Figure 2:
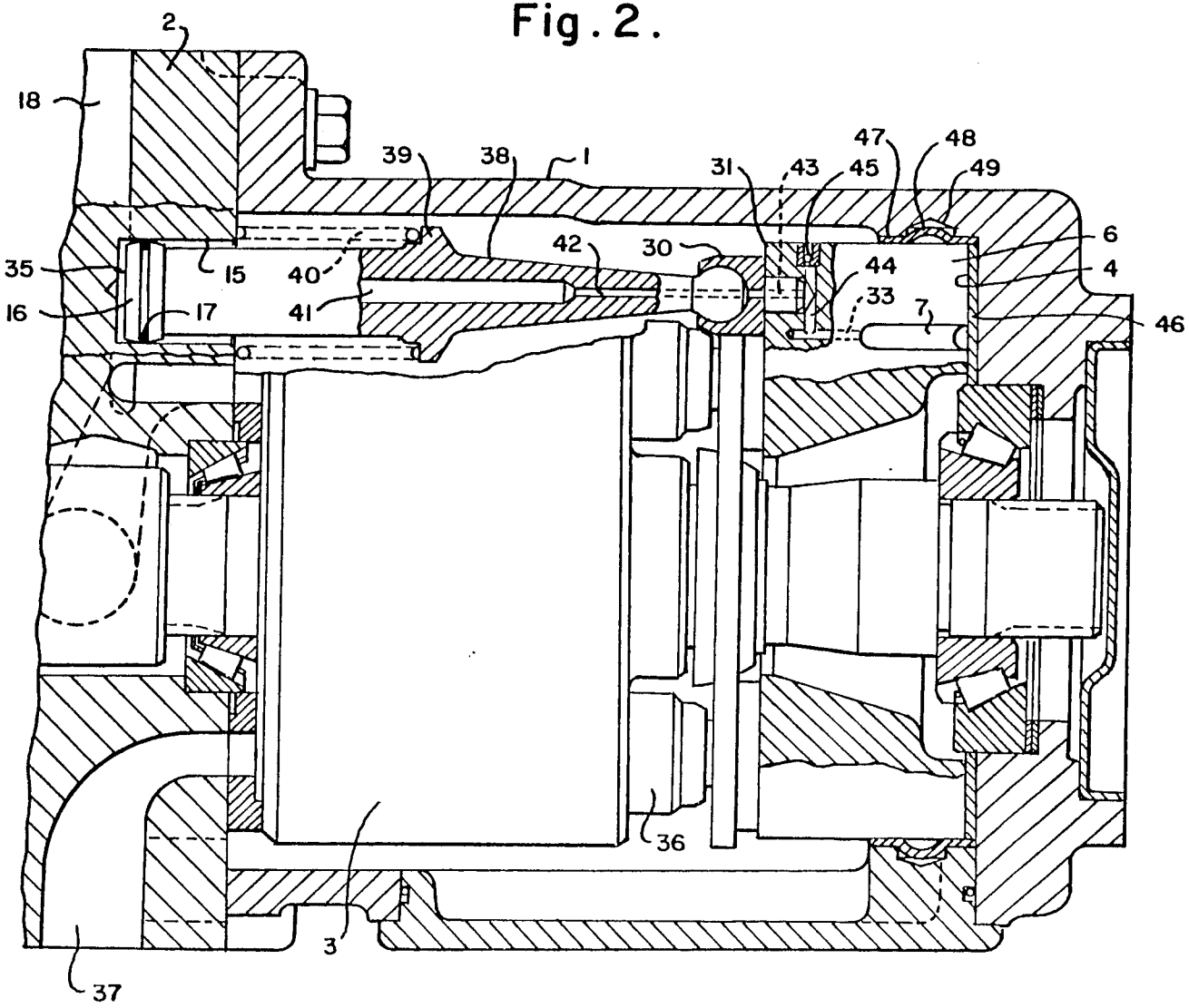
FIG. 2 shows a cross sectional view turned by 90° of the above.

It is evident from FIG. 2 that the operating cylinders 8 and 15 and the pressure pocket recess 7 in the rocker body 6 are located only on the high pressure side of the axial piston machine, on which the pistons 36 in the cylindrical drum 3 are loaded with high pressure fluid and on which the high pressure channel 18 is located, while such a recess is not provided in the rocker body 6 on the suction side, on which the suction channel 37 is located. While the rocker body 6 is shown in FIG. 1 in a swung-out position, it is shown in FIG. 2 in the zero-stroke position.

A somewhat different design is also shown in FIG. 2, such that here the piston rod section 38 of servo piston 16 is cylindrical in a piston-side section and is provided with a collar 39, against which the spring 40 is supported. Spring 40 serves here instead of spring 20 in FIG. 1. A borehole 41 is however also provided here in the servo piston 16 and in the piston rod section 38; it continues in a borehole 42 in the narrower section of the piston rod section 38 and is connected with a borehole 43 in the ball socket 30, in which case the bottom section of the borehole in rocker body 6, into which the pin 30 is inserted, is connected with a transverse borehole 44, which is closed off by a plug 45, whereby this transverse borehole 44 is first connected with the borehole 33, which is also connected with the pressure pocket 7. The bearing surface 4 is formed on a sliding metal socket 46. In order to secure the rocker body 6 against lateral deflection, a guiding plate 47 is provided between it and the housing 1. In order to prevent the latter from shifting during the swivelling of the rocker body 6, it is provided with a projection 48 that extends in to a borehole 49 of the housing 1.

Figure 3:
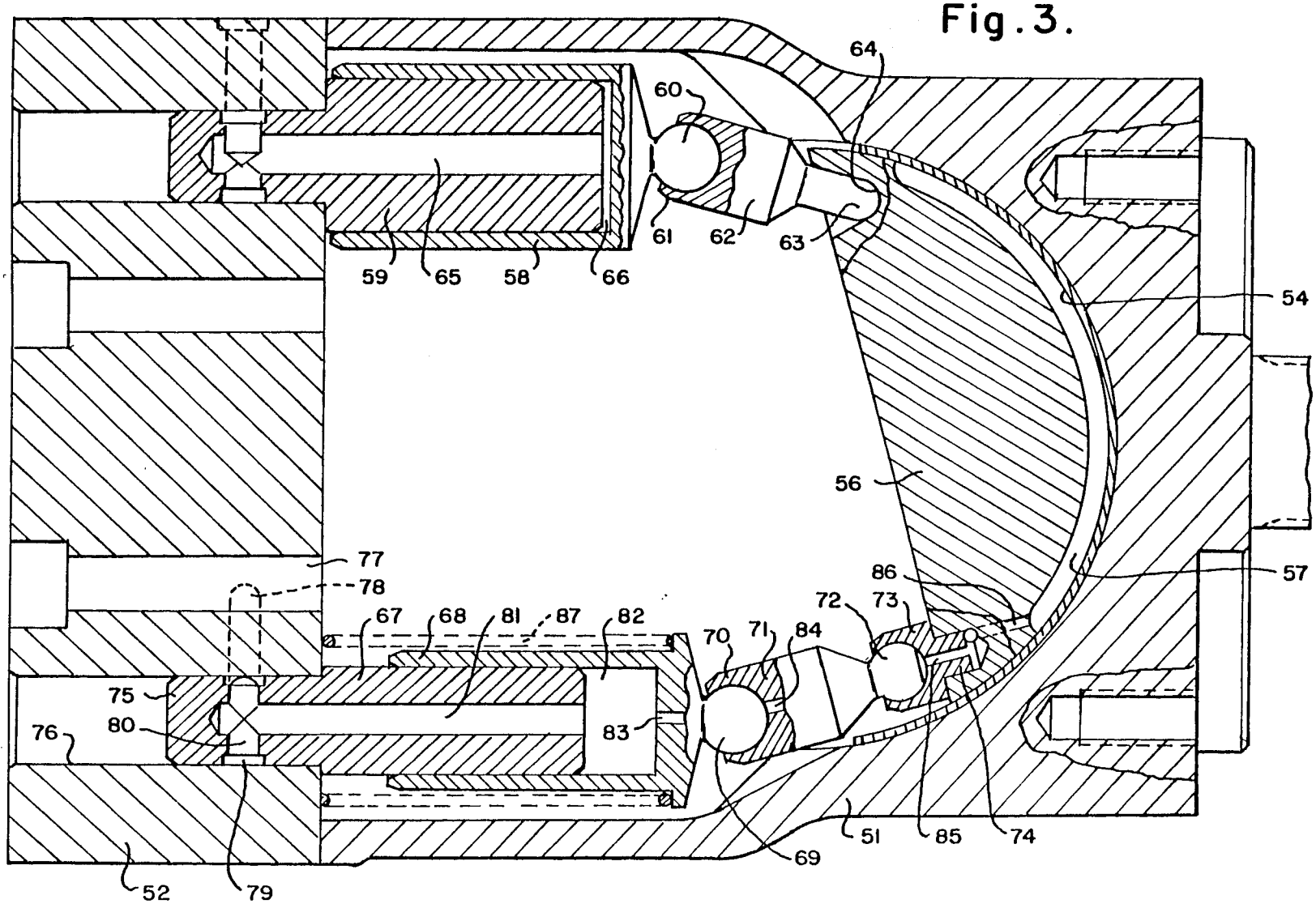
FIG. 3 shows a cross section of another design of the adjusting mechanism.

In the embodiment according to FIG. 3, housing 51 essentially corresponds to the housing 1 in the designs according to FIGS. 1 and 2 and the housing bottom ("control bottom") 52 corresponds to the housing bottom 2. The operating cylinder 58 is capable of sliding on the servo piston 59 only axially, that is, only for a pure translatorial linear displacement. The operating cylinder 58 is provided with a ball head 60 that extends into a ball socket 61 of an intermediate element 62, which in turn is supported in a recess 64 of the rocker body 6 with a ball stud 63 in an articulated manner. The servo piston 59 is provided with a bore hole 65, through which the pressure chamber 66 can be loaded with pressure medium.

Analogously, the servo piston 67 of smaller diameter is rigidly supported in the housing bottom 52 and an operating cylinder 68 is supported on the latter, capable of sliding only in the longitudinal direction. The operating cylinder 68 is provided with a ball head 69 on which the intermediate element 71 is supported by means of a ball socket 70. The intermediate element 71 is also supported with a ball head 72 in the ball socket 73, which is supported with a pin 74 in a matching borehole of the rocker body 56.

The fastening pin 75 of the servo piston 67 is secured in a borehole 77. The borehole 77 is the high pressure fluid channel. The latter is connected through a transverse borehole 78 with an annular groove 79 on the section 75, in which case a transverse borehole 80 extends from the annular groove 79 and is connected with a longitudinal borehole 81 that empties in the face surface of the servo piston 67 and thus in the pressure chamber 82. A borehole 83 is provided in the operating cylinder 68. It empties in the surface of the ball head 69 and is connected with a borehole 84 that in turn empties in the surface of ball head 72 and is connected there with a borehole 85 that empties in a borehole 86, which in turn empties in the pressure pocket recess 57. The cylinder 68 is supported against the spring 87.

In the foregoing specification certain preferred practices and embodiments of this invention have been set out, however, it will be understood that this invention may be otherwise practiced within the scope of the following claims.

I claim:

1. An adjustable axial piston machine comprising a housing, a source of high pressure fluid, an adjusting mechanism in said housing consisting of at least one operating cylinder that is connected with said high pressure source, a servo piston capable of sliding in said cylinder, a revolving cylindrical drum having cylindrical bores in said housing, working pistons in said bores capable of sliding therein a swash plate in supporting connection with said pistons, said swash plate being formed on a rocker body which is in operating connection with the adjusting mechanism and has at least one semi-cylindrical support surface, a hollow-cylindrical bearing surface in the housing against which said at least one semi-cylindrical surface bears, a pressure pocket recess connected with said high pressure source located in one of said semi-cylindrical surfaces and being loaded with pressure medium from the high pressure source through channels effected in the rocker body whereby a pressure cushion is formed between said at least one semi-cylindrical surface and the hollow cylindrical bearing surface in the housing, the connection between the high pressure source and the pressure pocket recess being provided through passages in the operating cylinder pressure chambers and the servo piston connecting the source of high pressure fluid and said pressure pocket recess.

2. Axial piston machine according to claim 1, characterized in that the servo piston is guided with a spherical section at one end in a swivellable manner in the operating cylinder and is supported through a ball-and-socket joint against the rocker body, and in which boreholes connected with each other and with the channel in the rocker body are located in the servo pistons and in the ball-and-socket joint.

3. Axial piston machine designed as an axial piston pump delivering in only one direction according to claim 1, characterized in that the pressure pocket recess in the rocker body and the channels and boreholes carrying the pressure medium to the pressure pocket recess are located only on the side of the rocker body on which the pistons loaded with high pressure are supported against the rocker body.

* * * * *